United States Patent [19]

Baugh

[11] Patent Number: 4,632,603

[45] Date of Patent: Dec. 30, 1986

[54] MARINE RISER BASE SYSTEM

[75] Inventor: Benton F. Baugh, Houston, Tex.

[73] Assignee: Mobil Oil Corporation, New York, N.Y.

[21] Appl. No.: 727,167

[22] Filed: Apr. 25, 1985

[51] Int. Cl.[4] ..... B63C 11/00; E02D 21/00

[52] U.S. Cl. ..... 405/210; 405/195; 166/345

[58] Field of Search ..... 405/195, 210, 202, 223; 166/343, 345, 341, 342; 141/387

[56] References Cited

U.S. PATENT DOCUMENTS

| | | | |
|---|---|---|---|
| 3,518,836 | 7/1970 | Itokawa | 405/210 |
| 3,837,310 | 9/1974 | Toyama | 405/210 X |
| 4,147,456 | 4/1979 | Klass | 405/210 |
| 4,182,584 | 1/1980 | Panicker et al. | 405/195 |
| 4,266,888 | 5/1981 | Bayer et al. | 405/202 |
| 4,335,979 | 6/1982 | Stafford | 405/202 |
| 4,398,846 | 8/1983 | Agdern | 166/345 X |

OTHER PUBLICATIONS

OTC 4512 "Deepwater Production Riser", Panicker and Yancey, presented at the 15th Annual Offshore Technology Conference, Houston, Tex. May 2–5, 1983.

*Primary Examiner*—Dennis L. Taylor

*Attorney, Agent, or Firm*—Alexander J. McKillop; Michael G. Gilman; Charles J. Speciale

[57] ABSTRACT

A marine riser base system including a flex means for fluidly connecting a riser flowline carried by a marine riser to the interior of a fluid-tight hull of a submerged structure. The hull, e.g. a subsea atmospheric riser manifold (SARM), is positioned on the marine bottom and has a platform positioned above and isolated therefrom to which the lower end of the riser is connected. The flex means is comprised of a length of rigid pipe having a curved portion therein which connects a flowline connector on the platform to the interior of the hull. The pipe extends from the flowline connector, around the external surface of the hull, and penetrates the hull on the lower side thereof. The cyclic forces experienced by the platform are distributed along the length of pipe due to the relative flexibility of the curved portion thereof which provides a long operational life of the flex means.

5 Claims, 3 Drawing Figures

MARINE RISER BASE SYSTEM

DESCRIPTION

1. Technical Field

The present invention relates to a means for fluidly connecting a flowline of a marine riser system to a submerged fluid source or the like and more particularly relates to a marine riser base system having a flexible connection means for fluidly connecting a flowline carried by a marine riser with the interior of the fluid-tight hull of a submerged flowline manifold or the like which is preset on a marine bottom.

2. Background Art

In certain marine areas (e.g. water depths below several hundred meters), subsea production and gathering systems are used to produce fluids from submerged wellhead which are completed on the marine bottom. In such systems, submerged flowlines for production fluids, hydraulic control fluids, injection fluids, etc. are laid along the marine bottom from adjacent and/or remote locations to a central gathering point where they are connected to a marine riser which, in turn, extends upward to the surface.

In certain of these subsea systems, the submerged flowlines are connected to the marine riser through a fluid handling system housed in the fluid-tight hull of a subsea atmospheric riser manifold (SARM) which, in turn, is positioned on the marine bottom at the central gathering point. Since considerable forces must be withstood at the point where the lower end of the riser is connected to a SARM or equivalent structure, the riser is connected to a support structure which spans the SARM and which is secured to the marine bottom by piles or the like. The support, normally called a "strongback" has a platform overlying the SARM to which the riser is connected. This effectively isolates the SARM from the forces experienced by the platform when currents, etc. act on the riser to move it back and forth from vertical.

Although the strongback structure is effective in isolating the SARM from the forces exerted on the riser, a different problem arises in connecting the various flowlines on the riser, itself, to their complementary flowlines or fluid sources in the SARM. That is, the moment forces on the riser are translated to the platform of the strongback which inherently cause some cyclic movement of the platform. Accordingly, if the flowlines from the SARM are connected from the top thereof directly to flowline connectors on the platform by fixed conduits or the like, the cyclic movement of the platform continuously stresses and relaxes these conduits thereby leading to possible early failure of the conduits.

Further, the close proximity of the strongback to the top of the SARM and the relative flexibility of the strongback complicates any connections used between the top of the SARM and the flowline connectors on the platform. Therefore, it can be seen that, a need exists for a means for fluidly connecting the interior of a SARM or the like to the riser flowlines on the support platform which is capable of compensating for the almost constant cyclic movement of the platform without premature failure due to the stresses involved.

DISCLOSURE OF THE INVENTION

The present invention provides a marine riser base system having a flex means for fluidly connecting flowlines carried by a riser to complementary fluid sources within a submerged structure wherein the forces normally experienced by the riser will not cause early failure of the connecting means.

More particularly, the marine riser base system of the present invention comprises a submerged structure, e.g. a subsea atmospheric riser manifold or SARM, which is positioned on the marine bottom. A support member spans the SARM and has a platform which is positioned above and isolated from the fluid-tight hull of the SARM. A means is provided on the platform for securing the lower end of a marine riser to the platform. Since the platform is isolated from the hull, forces exerted on the riser which tend to rock or cycle the platform from horizontal will not be translated directly to the hull of the SARM.

Also on the platform is at least one flowline connector means which is adapted to be connected to the lower end of a flowline carried by the riser. In accordance with the present invention, the flowline connector means on the platform is fluidly connected to the interior of the hull by a flex means which penetrates the hull at a point through the lower side of the hull. More specifically, this flex means is comprised of a rigid pipe (e.g. steel pipe) which is fixed to the platform and the flowline connector means at one end and which extends externally of the hull to a point adjacent the lower side of the hull where it is secured to the hull at the point of penetration. A portion of the pipe which extends externally is circularly-curved to conform with the surface of the hull and is spaced therefrom so that it is out of contact therewith.

As forces exerted on the platform by action of the riser are transmitted to the pipe, they are distributed over the curved portion of the pipe due to the relative, flexibility thereof, and do not set up fixed stress points therein which would likely lead to early failure. The flex connecting means of the present invention has been theoretically determined to have an infinite cycle life under conditions reasonably anticipated to be encountered by the present riser base system.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
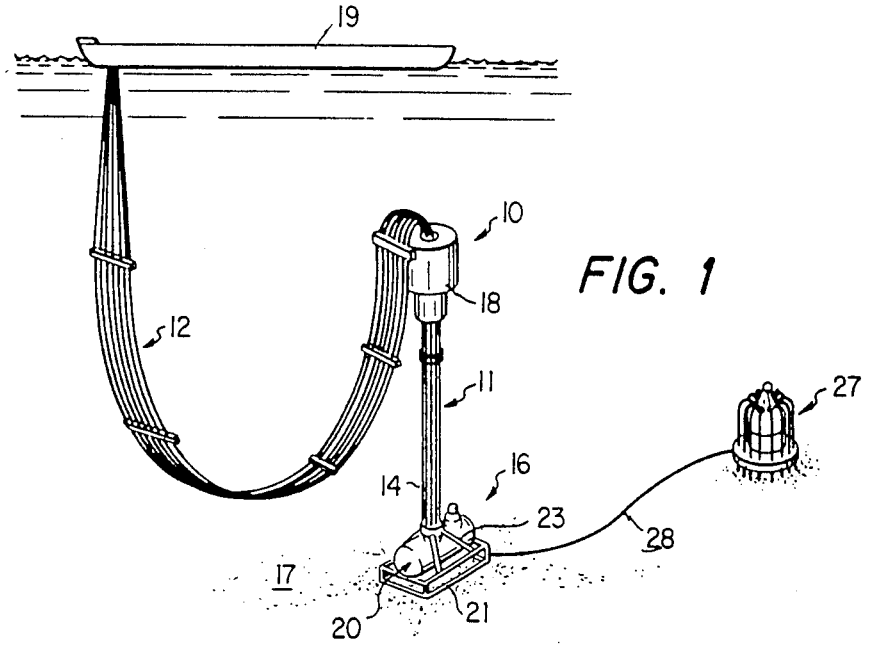
FIG. 1 is a perspective view of a typical environment, e.g. a marine compliant riser system, in which the present invention may be used.
Figure 2:
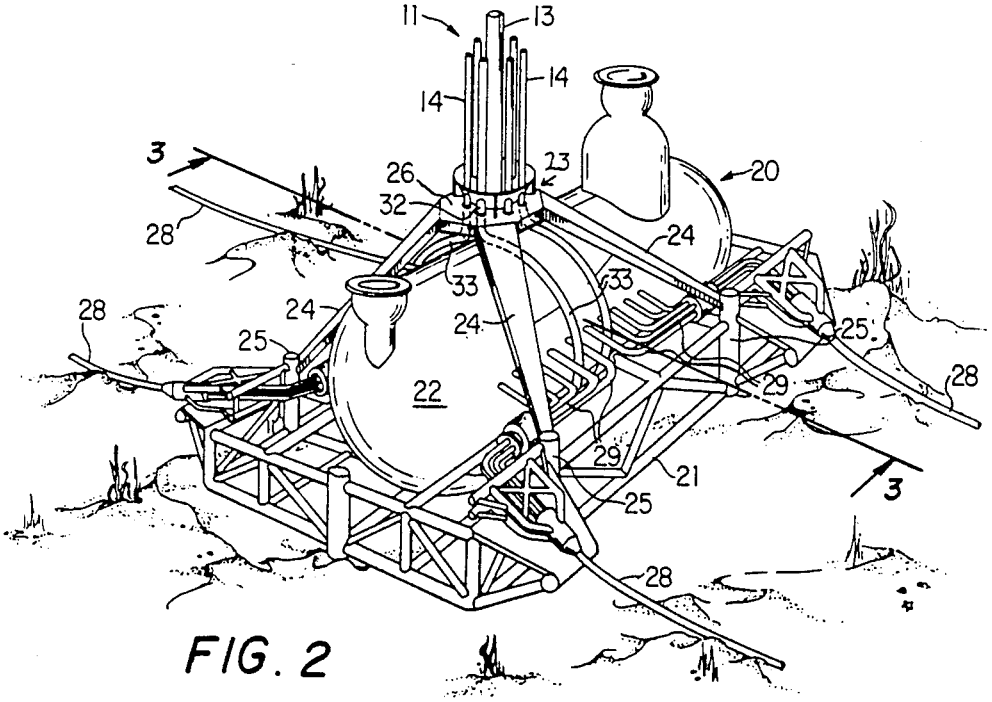
FIG. 2 is a perspective view of the marine riser base system of the present invention.

Referring now to the drawings, FIG. 1 discloses a typical environment in which the connecting means of the present invention may be used. More particularly, FIG. 1 discloses a typical compliant marine riser system 10 in an operable position at an offshore location. Riser system 10 is comprised of a lower rigid section 11 and an upper flexible section 12. Rigid section 11 is comprised of a core section 13 and a plurality of riser flowlines 14 carried thereby (see FIG. 2). Rigid section 11 is connected at its lower end to a base 16 which is preset on marine bottom 17 and has a buoy 18 on its upper end to maintain section 11 in a substantially vertical position in the water.

Flexible section 12 is comprised of a plurality of flexible flowlines which are connected to respective riser flowlines 14 and which extend to the surface where they are connected to a floating production facility 19.

As illustrated, (FIG. 2) base 16 is comprised of a subsea atmospheric riser manifold (SARM) 20 which is supported on marine bottom 16 by base template 21. SARM 20 is comprised of fluid-tight pressure hull 22 which encloses manifold piping, valves, etc. (not shown) and preferably a control room for sustaining human life in a substantially atmospheric pressure environment. A support structure 23 called a "strongback" has a platform 26, which overlies hull 22, and a plurality of legs 24 which are welded or otherwise secured to pile guides 25 on template 21. By mounting strongback 23 directly to template 21, it can be seen that hull 22 will be effectively isolated from any forces exerted on platform 26.

Production fluids from a submerged well or a cluster of wells 27 (FIG. 1) are flowed through a submerged flowline 28 (FIGS. 1 and 2) and flowed into hull 22 through penetrators 29. For a more detailed description of SARM 20 and support structure 23, see U.S. Pat. No. 4,398,846 which is incorporated herein by reference.

Figure 3:
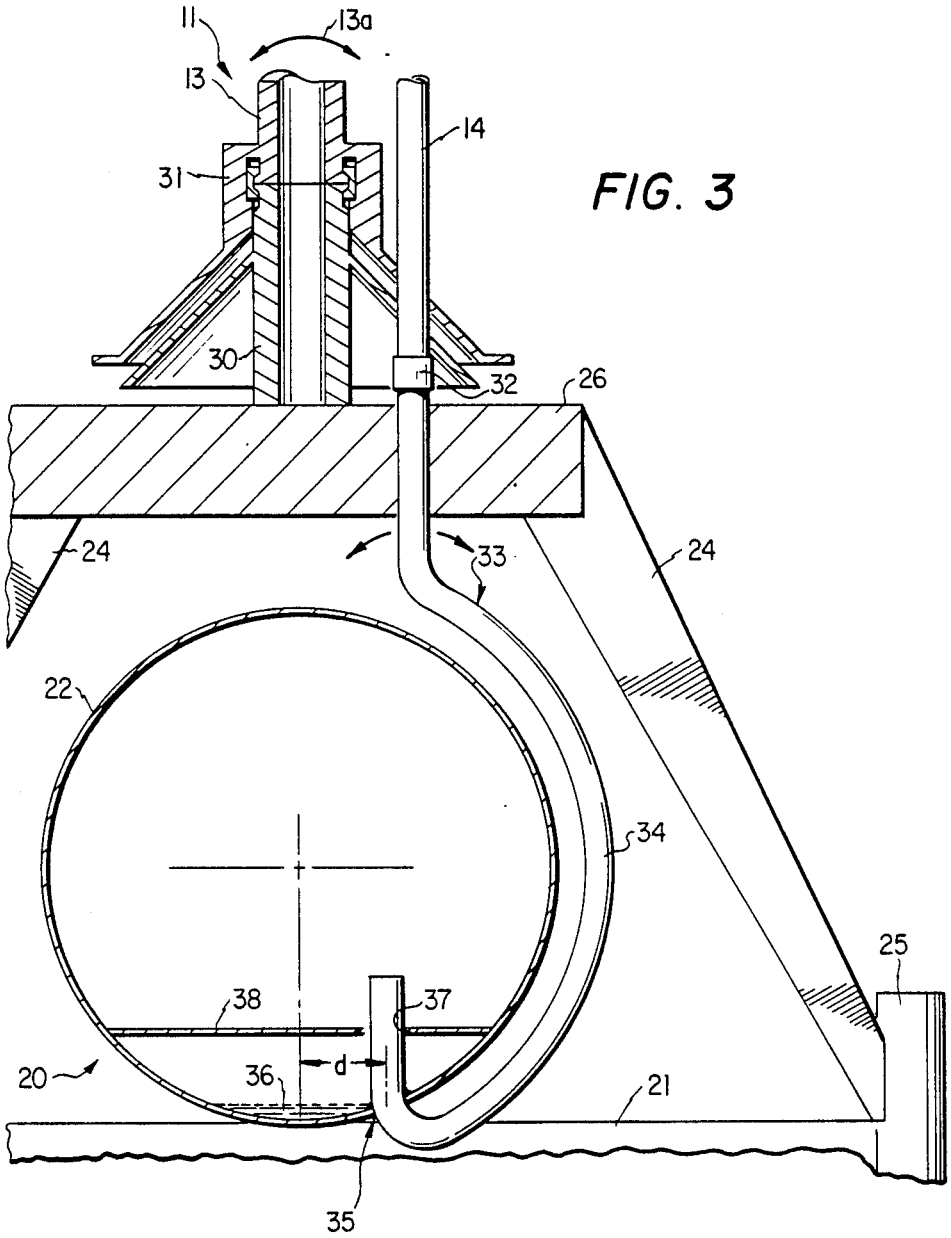
FIG. 3 is a cross-sectional view of the marine riser system taken along line 3—3 of FIG. 2.

As best seen in FIG. 3, platform 26 has an upstanding mandrel 30 to which riser core 13 is connected by a hydraulic connector 31. Platform 26 also has a plurality of flowline connector heads 32 (only one shown in FIG. 3) spaced thereon for connecting riser flowlines 14 to respective fluid sources within hull 22 as will be explained below. For a more detailed description of connector head 32 and means for connecting flowlines 14 thereto, see copending, commonly assigned U.S. patent application Ser. No. 722,087 filed Apr. 11, 1985 and incorporated herein by reference.

In previous systems of this type, it was proposed to connect a fluid source within hull 22 to a connector head on platform 26 by a fixed rigid conduit (not shown) which extended through the top of hull 22. As water conditions (e.g. currents) applies forces to riser 10, rigid section 11 of riser 10 undergoes limited back and forth cyclic movement from vertical which, in turn, applies cyclic forces (arrow 13*a*, FIG. 3) to mandrel 30 and, hence platform 26. It can be seen that this rocking or cyclic motion of platform 26 will continuously stress and relax any rigid conduit between platform 26 and hull 22 and that such forces will be concentrated at a fixed point within a conduit at which a conduit is likely to fail. Also, substantial forces will be translated to the skin of hull 22 where a rigid conduit penetrates the hull which can also lead to early failure of the system.

In accordance with the present invention, a flex fluid connecting means 33 is used to connect flowline connector head 32 to the interior of hull 22. Means 33 is comprised of a length of substantially rigid pipe (e.g. steel pipe) which has a circularly-curved portion 34 therein. The upper end of pipe 33 is fixed to platform 26 and carries connector head 32 thereon. Pipe 33 is rigidly connected to platform 26 so that there is no sliding wear therebetween. The lower end of pipe 33 is fixedly connected to SARM 20 where it penetrates hull 22 by welding or by suitable flange (not shown). The point 35 at which pipe 33 penetrates hull 22 is preferably offset from the vertical centerline of hull 22 by a distance d necessary to keep pipe 33 out of the bilge water 36 (e.g. approximately 6" deep at deepest point) which is normally present in hull 22. As shown in FIG. 3, pipe 33 extends substantially vertical after it penetrates hull 22 and is preferably loosely passed through an opening 37 in floor 38 of SARM 20 where it is connected to valves, etc. (not shown) within hull 22.

Circularly-curved portion 34 of pipe 33 is formed so as to substantially conform to the outer surface of hull 22 and is spaced therefrom so as not to be in contact with hull 22. It can be seen that as platform 26 is rocked or cycled by the forces applied through mandrel 30 and riser section 11, the curved portion 34 acts as a flex means to distribute these forces throughout the length of pipe 33 rather than concentrating these forces at substantially one fixed point in the connecting means as is the case in rigid connectors previously proposed for this purpose.

What is claimed is:

1. A marine riser base system comprising:

a fluid-tight hull positioned on the marine bottom;

a support member comprising;

a platform;

means for securing said platform above said hull;

means on said platform adapted for securing the lower end of a marine riser to said platform;

flowline connector means on said platform adapted to be connected to the lower end of a flowline carrier by said marine riser; and a means for fluidly connecting said flowline connector means on said platform to the interior of said hull through a point on the lower side of said hull; said means comprising:

a length of rigid pipe having a circularly-curved portion conforming substantially to the surface of said hull and spaced therefrom; said pipe having one end fixed to said platform and having said flowline connector means thereon and having its other end fixed to the lower side of said hull where said other end penetrates said hull.

2. The system of claim 1 wherein the point at which said other end of said pipe penetrates said lower side of said hull is offset from the vertical centerline of said hull by a distance required to prevent entry of said other end into any bilge water normally in the bottom of said hull.

3. The system of claim 2 wherein said hull comprises a subsea atmospheric riser manifold.

4. The system of claim 3 including:

a floor in said hull;

and wherein said other end of said pipe extends substantially vertical from the point of penetration in said hull through an opening in said floor.

5. The system of claim 4 wherein said pipe is comprised of steel.

* * * * *